US009476228B2

(12) United States Patent
Karcz et al.

(10) Patent No.: US 9,476,228 B2
(45) **Date of Patent: *Oct. 25, 2016**

(54) LATCHES FOR GATES AND DOORS

(71) Applicant: D & D Group Pty Ltd, Frenchs Forest (AU)

(72) Inventors: Irek Karcz, Cromer (AU); Anthony John Clark, Cremorne (AU); Margaret Antkowiak, Dee Why (AU)

(73) Assignee: D & D Group Pty Ltd, French Forest (AU)

( * ) Notice: Subject to any disclaimer, the term of this patent is extended or adjusted under 35 U.S.C. 154(b) by 0 days.

This patent is subject to a terminal disclaimer.

(21) Appl. No.: 14/636,746

(22) Filed: Mar. 3, 2015

(65) Prior Publication Data

US 2015/0191938 A1 Jul. 9, 2015

Related U.S. Application Data

(63) Continuation of application No. 13/568,826, filed on Aug. 7, 2012, now Pat. No. 8,966,947, which is a continuation of application No. 11/699,665, filed on Jan. 30, 2007, now abandoned.

(30) Foreign Application Priority Data

Jan. 31, 2006 (AU) ..... 2006900450

(51) Int. Cl.
*E05B 65/06* (2006.01)
*E05B 57/00* (2006.01)
(Continued)

(52) U.S. Cl.
CPC ..... *E05B 65/06* (2013.01); *E05B 57/00* (2013.01); *E05B 65/0007* (2013.01); *E05C 3/24* (2013.01);
(Continued)

(58) Field of Classification Search
CPC .... E05B 65/06; E05B 57/00; E05B 65/0007; E05C 3/24; E05C 3/30; Y10S 292/13; Y10S 292/37; Y10T 292/1047; Y10T 292/1092; Y10T 70/5354; Y10T 70/5363; Y10T 70/7486; Y10T 70/5345; Y10T 70/5469; Y10T 70/7559; Y10T 70/5199; Y10T 70/5204; Y10T 70/55
USPC ..... 70/135–139, 484, 485, DIG. 73, 77, 70/101, 102, 95–97, 150, 151 R, 151 A, 70/154, 155; 292/194, 216, 219, 220, 224, 292/210, DIG. 13, DIG. 29, DIG. 37, DIG. 46
See application file for complete search history.

(56) References Cited

U.S. PATENT DOCUMENTS 1,530,341 A 3/1925 Bannochie
1,538,056 A 5/1925 Olson
(Continued)

FOREIGN PATENT DOCUMENTS

AU 2012101659 A4 12/2012
AU 2012101660 A4 12/2012

*Primary Examiner* — Lloyd Gall
(74) *Attorney, Agent, or Firm* — Kelly & Kelly, LLP

(57) ABSTRACT

A latch has a displaceable latching element in a housing for engagement with a separate striker arm to be latched behind an engagement shoulder of the latching element. The housing mounts a cylinder lock to receive a key from the front. A rotor is mounted on the rear of cylinder lock and rotation of the key rotation the rotor to drive a locking element to engage and lock the latching element. The rotor may also be axial displaceable against spring biasing responsive to a rear unit pushing element whereby unlocking from a rear cylinder lock may rotate the rotor to unlock and pushing causes the latching element to be displaced against its biasing to release the striker arm. Embodiments include a gravity biased and manually opened latch and a spring biased self-locking embodiment.

17 Claims, 14 Drawing Sheets

(51) Int. Cl.

| | |
|---|---|
| ***E05B 65/00*** | (2006.01) |
| ***E05C 3/24*** | (2006.01) |
| ***E05C 3/30*** | (2006.01) |

(52) U.S. Cl.

CPC ..... *E05C 3/30* (2013.01); *Y10S 292/13* (2013.01); *Y10S 292/37* (2013.01); *Y10T 70/5199* (2015.04); *Y10T 70/5204* (2015.04); *Y10T 70/5345* (2015.04); *Y10T 70/5354* (2015.04); *Y10T 70/5363* (2015.04); *Y10T 70/5469* (2015.04); *Y10T 70/55* (2015.04); *Y10T 70/7486* (2015.04); *Y10T 70/7559* (2015.04); *Y10T 292/1047* (2015.04); *Y10T 292/1092* (2015.04)

(56) References Cited

U.S. PATENT DOCUMENTS

| | | | | |
|---|---|---|---|---|
| 1,789,775 | A | 1/1931 | Russ et al. | |
| 2,058,163 | A | 10/1936 | Malone | |
| 2,218,183 | A | 10/1940 | Springer | |
| 2,767,007 | A | 10/1956 | Burke | |
| 2,839,912 | A | 6/1958 | Corbin et al. | |
| 3,040,555 | A | 6/1962 | Wartian | |
| 3,161,036 | A | 12/1964 | Himes | |
| 3,593,547 | A | 7/1971 | Taylor | |
| 3,677,591 | A | 7/1972 | Waldo | |
| 3,705,505 | A | 12/1972 | Landow et al. | |
| 3,890,813 | A | 6/1975 | Cothron | |
| 4,014,192 | A | 3/1977 | Dillon et al. | |
| 4,025,095 | A | 5/1977 | Hausladen | |
| 4,073,520 | A | 2/1978 | Tsuchiya et al. | |
| 4,177,656 | A | 12/1979 | Davis | |
| 4,414,828 | A | 11/1983 | Takinami et al. | |
| 5,103,658 | A | 4/1992 | McQuade | |
| 5,526,659 | A | 6/1996 | Takimoto | |
| 5,655,801 | A | 8/1997 | Casey | |
| 6,058,747 | A | 5/2000 | Doyle et al. | |
| 6,327,879 | B1 | 12/2001 | Malsom | |
| 6,513,351 | B2 | 2/2003 | Clark | |
| 6,898,953 | B1 | 5/2005 | Paprocki et al. | |
| 7,201,030 | B2 | 4/2007 | Timothy | |
| 7,347,460 | B2 | 3/2008 | Ala | |
| 8,127,578 | B2 | 3/2012 | Karcz et al. | |
| 8,646,815 | B2 | 2/2014 | Timothy et al. | |
| 8,966,947 | B2 * | 3/2015 | Karcz et al. | 70/135 |
| 9,003,842 | B2 * | 4/2015 | Karcz et al. | 70/135 |
| 2005/0184532 | A1 | 8/2005 | Karcz et al. | |
| 2005/0225098 | A1 | 10/2005 | Kliefoth et al. | |
| 2010/0045055 | A1 * | 2/2010 | Taglianetti | 292/341.15 |

* cited by examiner

LATCHES FOR GATES AND DOORS

This application is a continuation of U.S. Pat. No. 8,966,947, filed Aug. 7, 2012, which is a continuation of U.S. patent application Ser. No. 11/699,665 filed Jan. 30, 2007 (abandoned), which claims priority of Australian Patent Application No. 2006900450, filed Jan. 31, 2006, the contents of which are incorporated herein by cross reference.

FIELD OF THE INVENTION

The present invention relates to latches for gates and doors and more particularly is concerned with a latch of the type wherein a displaceable latching element (usually called a tongue) has a latching shoulder to engage with a striker arm with respect to which it is relatively moveable, the tongue having a striker surface adapted to engage with the striker arm to displace the tongue to permit engagement of the striker arm behind the latching shoulder. Typically, but not always, the biasing of the tongue will be under gravity, for example through a pivotal mounting and there is an arrangement to permit the tongue to be displaced to release the striker arm whereby a gate or door is then released to be moved relative to a gate post or door post.

The field of the invention extends to devices having spring biased tongues as well as gravity biased tongues and, in addition, extends to tongues which are both gravity and spring biased.

BACKGROUND TO THE INVENTION

Various forms of latches and, in particular, gravity latches, have been previously proposed such as U.S. Pat. No. 6,058,747 (Doyle) and U.S. Pat. No. 6,513,351 (Clark), both of which are assigned to the assignees of the present invention. These two US patents disclose specific developments in the field of latches for gates and doors. Other known prior latches in the field of those referred to as references in the printed specifications of the two US patents mentioned above. The prior art listed comprises:

| | |
|---|---|
| 204,267 | Unger |
| 2,313,712 | Jacobi |
| 2,953,916 | Thomas |
| 3,115,026 | Moore |
| 3,433,518 | Foltz |
| 3,593,547 | Taylor |
| 3,677,591 | Waldo |
| 3,785,186 | James et al |
| 3,838,877 | Hanson |
| 4,014,192 | Dillon et al |
| 4,378,684 | Dugan et al |
| 4,691,541 | McQuade et al |
| 4,732,418 | Crown et al |
| 4,919,463 | McQuade, Sr. |
| 4,938,508 | Thomas |
| 5,024,473 | McQuade |
| 5,063,764 | Amis et al |
| 5,103,658 | McQuade |
| 5,358,292 | Van Wiebe et al |
| 6,058,747 | Doyle et al |
| 6,347,819 | Plaxco |

U.S. Pat. No. 6,058,747 (Doyle et al) has a disclosure of a gravity latch having an enshrouded tongue and the lock mounted to be accessible from the front face. The disclosure includes a rear actuator unit adapted to be mounted on the opposite or rear face of a gate post so that, subject to any unlocking required of the rear unit, the tongue can be raised by the rear actuator to release the striker arm so that the gate may be opened from the rear side.

U.S. Pat. No. 6,513,351 (Clark) is a development with cylinder locks provided in front and rear units and respectively key operated to rotate a locking element into and out of a locking position. In the locking position the gravity biased tongue is locked in a retaining position in which the associated striker arm is held in position.

The prior published specifications referred to above are mentioned as an illustration of the background but in doing so, no admission is made that any of the specifications form part of the common general knowledge in Australia or any other geographical region.

In this specification, unless the context requires otherwise, the word "comprising" is used in the non-exhaustive sense and further features may be present in the arrangement described.

The present invention is directed to new and useful alternatives to known arrangements.

SUMMARY OF THE INVENTION

According to one aspect of the present invention, there is provided a latch for holding closed a gate (or door) wherein the latch is adapted to co-operate with a striker arm, the latch comprising:

(a) a housing in which (b) a displaceable latching element is mounted to be displaceable from a latching position towards an open position in which the striker arm is released for gate opening, and (c) the latching element having a latching shoulder to retain the striker arm when engaged behind the latching shoulder and having an engagement surface adapted to be engaged by the striker arm when the gate is moved towards a closed position to displace the latching element and for permitting relative movement of the striker arm to adopt a position behind the latching shoulder (d) a key-operated lock mounted in the housing and having a key operation for unlocking the latch.

(e) a locking element for locking the latching element and adapted to be displaced upon actuation of the key-operated lock between a locking position, in which movement of the latching element is restrained from moving, and a displaced position in which the latching element is free to be moved (f) the locking element being in the form of a rotor rotatably mounted in the housing and movable about its axis for directly engaging with and disengaging from the latching element and (g) the rotor having a portion remote from the lock capable of being engaged by a remote actuating unit which may be mounted on an opposite side of the gate post to the latch for remotely operating the latch via the rotor.

The lock may be a cylinder lock with a suitable lock-motion in an elongate tab for moving the rotor.

For locking engagement with the latching element, the rotor may have an aperture for receiving a locking portion of the latching element and a generally radially extending finger axially off-set from the aperture for engaging a heel portion of the rotor for engagement purposes.

The rotor may be configured to have a displacement of about 20° with the housing.

In one important line of embodiments, the rotor also has limited axial motion along the axial direction of the cylinder lock and is biased to a position away from the front cylinder lock, the rotor having a projecting element which is adapted to displace the latching element from the latching position towards an open position when the rotor has been moved from a locking position into a position in which the latching element is free to be moved, and the rotor is displaced against the biasing.

In these embodiments use can be made of a remote actuator unit with an axially displaceable element which engages with and displaces the rotor against spring biasing to cause remote actuation of the latching element to open the latch.

Such an embodiment lends itself to the provisions of a second cylinder lock in the remote actuator unit which is adapted to be connected to transmit a rotation of the rotor from the locking position to the open position and from the open position to the closed position whereby either the front lock or the rear lock can be used either to lock the latch or to open it.

Usually the latching element will be partially enshrouded in the casing with a protruding portion extending out of a face slot so as to facilitate manual lifting of the tongue when a lock has been unlocked.

The latching element may be located above the lock axis or below it and may simply be biased by gravity to the latching position, but it could be arranged to be otherwise biased, e.g. magnetically or by springs.

Particularly for embodiments which have the simplicity of a gravity latch, the shape of the latching element can be such that when a striker arm strikes the outer lower face of the latching element it is deflected pivotally upwardly so that the striker arm can engage behind the latch and the latching shoulder prevents opening of the gate. However, usually the embodiments are designed so that manual locking through the front lock or, if provided, the rear lock is to take place in order to lock the latch.

Instead of having a cylinder lock operated by a key in a rear unit in order to unlock the gate, a further embodiment is one in which egress can be provided by having a push button or a similar structure (such as an egress crash bar) mounted to be depressed axially and to drive a rack and pinion or worm and nut or similar mechanism to turn the locking element (or rotor) so that further action then causes the latching element to be displaced from the rear of the gate, thereby permitting opening, for example as might be required for emergency purposes or to ensure there can be exit from e.g. a shed to which the latch has been fitted with a key lock arrangement on the outside.

A second aspect of the invention, which may be used with features of the first aspect or may be used separately, consists in apparatus which has:

a latch for holding closed a gate (or door) wherein the latch is adapted to co-operate with a striker arm, the latch comprising:

(a) a housing in which (b) a displaceable latching element is mounted to be displaceable from a latching position towards an open position in which the striker arm is released for gate opening, (c) the latching element having a latching shoulder to retain the striker arm when engaged behind the latching shoulder and having an engagement surface adapted to be engaged by the striker arm when the gate is moved towards a closed position to displace the latching element and for permitting relative movement of the striker arm to adopt a position behind the latching shoulder, (d) a locking element for locking the latching element and adapted to be displaced upon actuation of a key-operated lock between a locking position, in which movement of the latching element is restrained from moving, and a displaced position in which the latching element is free to be moved, (e) the element being in the form of a rotor, and (f) the rotor being mounted on a base portion of the housing and capable of being displaced axially by a rear actuating unit having a connection through an aperture in the base portion of the housing for unlatching the latching element.

Embodiments include a case where the rotor is not rotatable by the remote actuating unit, although in other embodiments the remote actuating unit provides rotation for unlocking and axial displacement for unlatching.

It is possible for the lock to be in the remote actuator only or indeed the apparatus may be supplied with a lock or non-lock form for either or both of the latch and the remote actuating unit. A cylinder lock may be used.

Another series of embodiments can be arranged to provide a self-locking mechanism where the latching element may be essentially entirely enshrouded. In such an embodiment the latching element is biased from its latching position towards an open position at which the striker arm is released so that the gate can be opened.

When, in such a self-locking embodiment, the locking element is in the form of a rotor, such as that described herein, the rotor can be spring biased towards its locking position, the rotor being displaced by key operation in a rotary manner from the locking position to an unlocking position, the arrangement being such that under such key operation the latching element is released and providing the striker arm is allowed to be released, the latching element is maintained in a position which interferes with the rotor preventing it returning to its original locking position; the arrangement is such that when the striker bar again is pressed against the engagement portion of the latching element, it is displaced towards the latching position and releases the rotor which moves under its biasing force to the locking position, the rotor having an element engaging with the latching element to prevent movement of the latching element away from the latching position.

Embodiments include those in which the latching element is pivotally mounted and fully enshrouded in the housing apart from a striker arm retaining portion which extends across an opening through which the striker arm moves upon gate closure. Furthermore, the latching element can be spring biased to a raised position within the housing when released by opening the latch with key actuation.

Embodiments include those in which the locking element is a rotor rotatably mounted for rotation by key operation of the lock, which can be a cylinder lock mounted in the housing and accessible at a front face of the housing, whereby the housing can be a slim line structure. The rotor may have an associated torsion spring for urging it from a displaced position to a latching position.

The latch can be adapted to be mounted on a gate post with the structure adapted to be coupled if desired with a rear actuation unit to be mounted on the opposite rear face of the gate post. By the use of a cylinder lock in such a rear unit with conventional respective limited lost motion mechanisms in each cylinder lock, the latch unit can thus be formed such that unlocking can take place by either of the cylinder locks to rotate the locking element.

Embodiments include those in which the locking element is mounted in a cartridge holder which retains the components to facilitate removal and replacement of the cylinder lock, for example if the customer wishes to have the lock reset for common keying. A reassembly is thus facilitated without special tools or expertise. Furthermore, the arrangement can facilitate reassemble so that the device is configured for either left hand or right hand installation situations, for example, when the housing has an L-shaped base plate for mounting on a post and a cover shroud mounted on the base plate.

Thus embodiments of the invention, for the first time, provide a combination of features together which can be embodied in robust but simple componentry to provide a latch which can be purely gravity biased or gravity and spring biased to the locking position and/or can be self locking. Furthermore the latch can be of the form of having a front unit and rear unit for mounting on opposite sides of the gate post, such that either lock may be turned to permit opening of a gate by displacement of the locking element to release the locking tongue which then moves to allow the striker bar to move out of engagement as the gate or door is opened.

Although embodiments herein are described as key-actuated or manually actuated, remote electrically operated embodiments may be provided as an alternative to key actuators or in addition.

Thus the present invention lends itself to embodiments which provide a new combination of features.

BRIEF DESCRIPTION OF THE DRAWINGS

Embodiments of the invention will now be described with reference to the accompanying drawings of which.

DETAILED DESCRIPTION OF THE DRAWINGS

Figure 1:
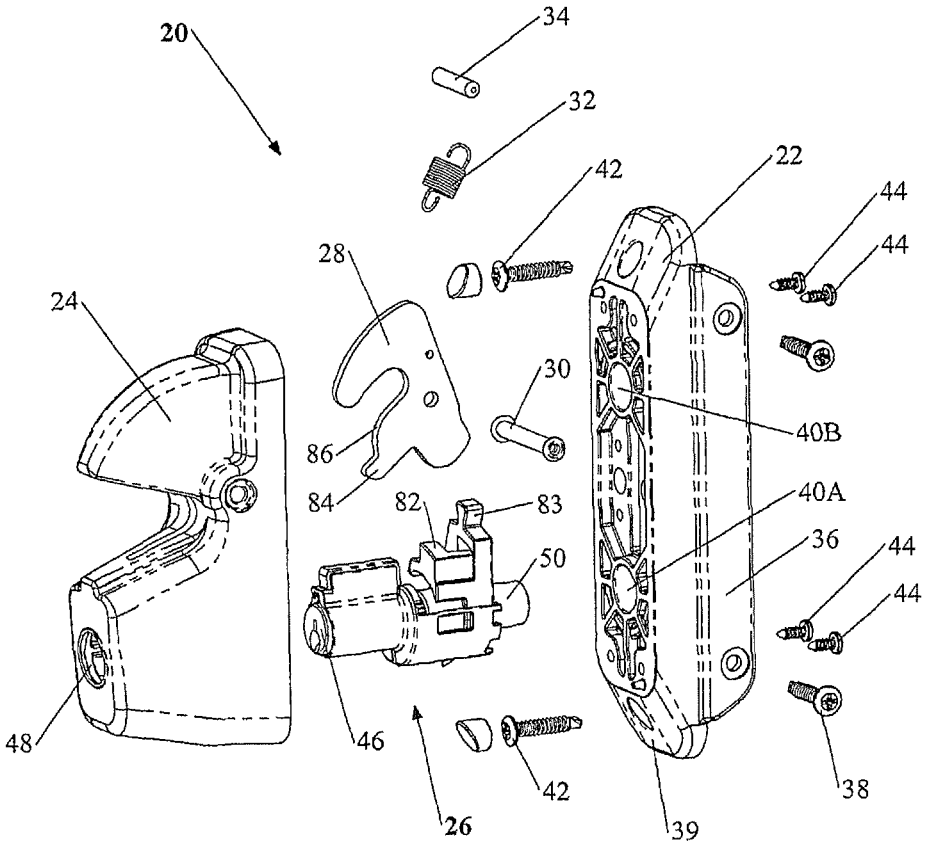
FIG. 1 is an exploded view of a front unit for a latch embodying the invention.

Referring first to the exploded view of FIG. 1, the front unit for a latch assembly is illustrated and is in the form of self-locking assembly with automation opening when key actuation of a lock occurs. The front unit is adapted to cooperate in use with a striker arm assembly shown in FIG. 2 and optionally to be employed with a rear access unit shown in exploded view in FIG. 4. As shown in FIG. 1, the latch unit comprises a housing 20 assembled from a base unit 22 and a front shell 24 within which is mounted a locking cartridge assembly 26 for cooperation with a pivotal latching element in the form of a tongue 28. The tongue is mounted in the shell 24 on a pivot pin 30 and the tongue is adapted to be biased upwardly to its open position by a helical extension spring 32 which, at its upper end, is mounted on a mounting pin 34 and, at its lower end, is connected directly to the tongue.

The base 22 is generally L-shaped in plan view and has a side leg 36 adapted to be engaged over the face of a gate post and secured to the gate post by screws 38. A main leg 39 of the base is symmetrical with two vertically spaced apertures 40A and 40B and this leg is also adapted to be secured to the gate post by upper and lower screws 42. The shell 24, when the components are assembled inside, is fitted to the base by a series of four screws 44 from the rear of the base into the shell 24 with the cylinder lock 46 of the cartridge engaged in a corresponding aperture 48 in the shell and a rear barrel portion 50 of the cartridge engaged in the lower aperture 40A.

So that the gate latch can be fitted to either left hand or right hand opening gates, the unit can be reassembled with the base 22 rotated through 180° so that the opening 40B is lower and adapted to be engaged by the barrel 50.

Figure 2:
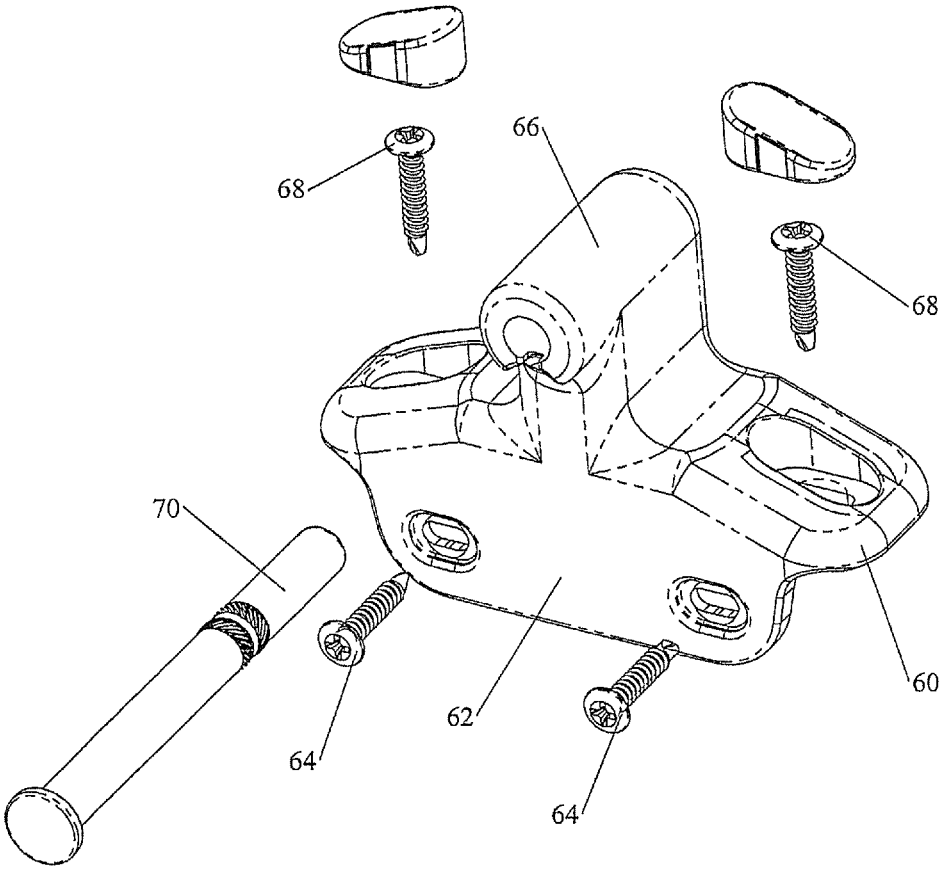
FIG. 2 is an exploded view of a complementary latching arm intended to be fitting to a gate.

The striker pin unit of FIG. 2 is adapted to be fixed to an edge portion of a gate and for that purpose has an L-shaped striker bracket 60 with a side leg 62 adapted to be secured to a side face of the gate by two fixing screws 64 and the other leg of the bracket has an integral upstanding body portion 66 also adapted to be secured to the gate but through a front face by two screws 68. The body portion mounts a steel striker pin 70.

Figure 3:
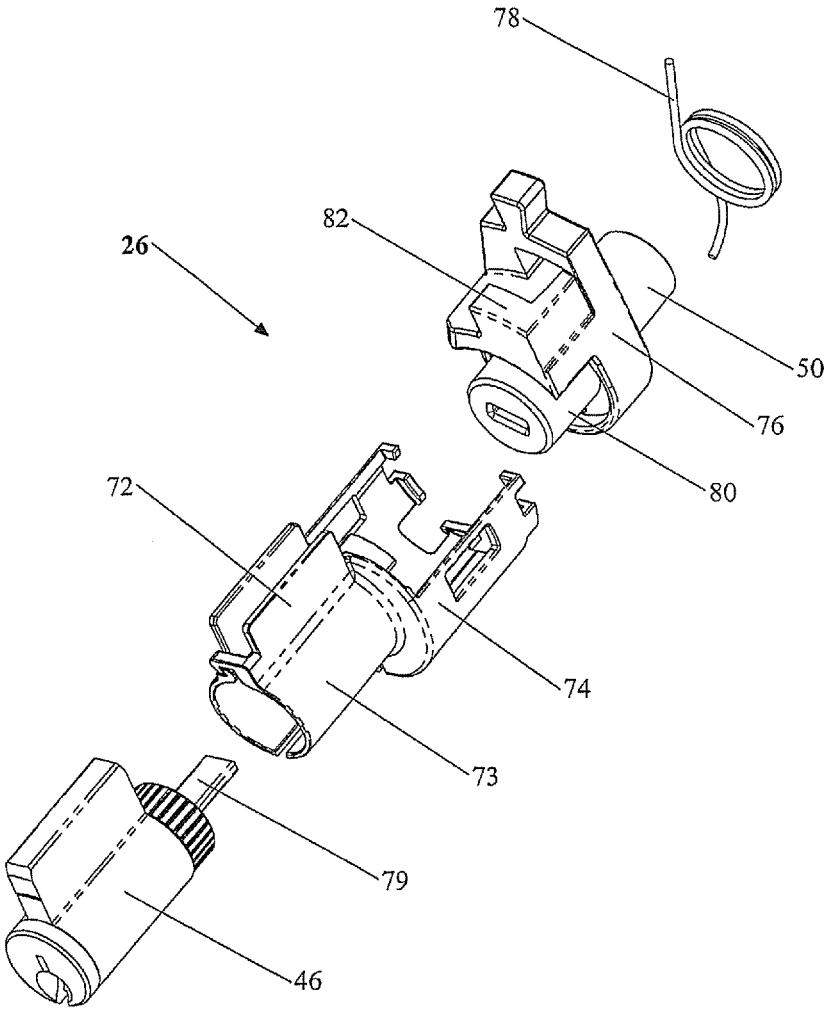
FIG. 3 is an exploded view of a cartridge assembly for the lock unit of FIG. 1.

FIG. 3 shows details of the cartridge 26 which comprises a plastic moulded holder 72 having a cylindrical portion 73 at one end to accommodate the cylinder lock 46 and a part cylindrical coaxial portion 74 for accommodating a locking element in the form of a rotor 76. A torsion spring 78 mounts over a rearwardly extending barrel 50, the barrel having a square-shaped axial aperture for accommodating a square actuation bar of a rear unit described below. Upon assembly, the torsion spring 78 is mounted to bias the rotor anti-clockwise as seen in FIG. 1 and FIG. 3 towards its locking position. The rotor has a front barrel 80 with a rectangular axial slot accommodating a conventional flat operating bar 79 extending from the cylinder lock 46. The cylinder lock conventionally has a degree of lost motion so that initial turning by a key does not turn the bar 79 or the rotor but further action in a clockwise sense (as seen in FIG. 1 and FIG. 3) then turns the rotor against its spring biasing to disengage a tongue retaining finger 82 of the rotor to release the tongue 28 to move upwardly under the biasing of spring 32, thereby releasing a striker arm so that the associated gate may be opened. The torsion spring 78 then acts to urge the rotor anti-clockwise (as seen in FIG. 1 and FIG. 3) until the side face of finger 82 inter-engages with a side face of the tongue 28 thereby holding the latch mechanism open and ready to be displaced by the striker pin when the gate is closed.

For this purpose, the tongue 28 has a protruding leg 84 (see FIG. 1) which interferes with the side of the finger 82 when the tongue is in the closed position. The profile of the tongue includes an abutment shoulder 86 configured such that when impacted by the striker arm 70, the tongue is rotated anticlockwise from the open position as seen in FIG. 1 to move the leg 84 rearwardly of the location of the finger 82, thereby releasing the rotor to turn under the force of the torsion spring 78 in an anticlockwise direction so that locking is automatically achieved.

Figure 5:
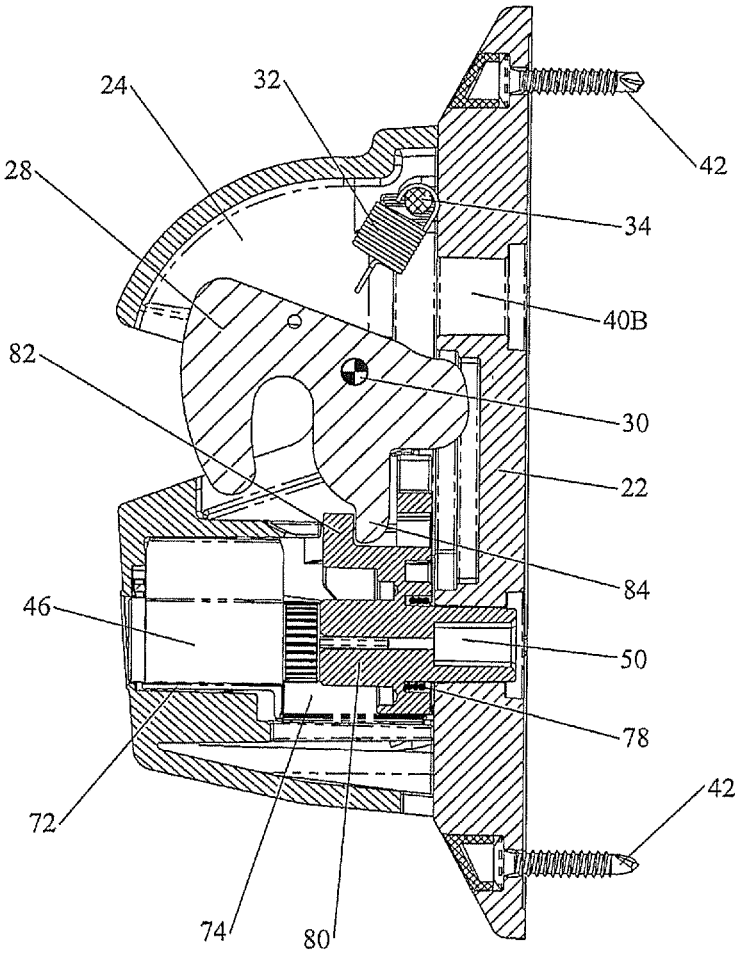
FIG. 5 is a cross-sectional view through the front unit showing the tongue in a latching position but prior to engagement with a striker bar.
Figure 6:
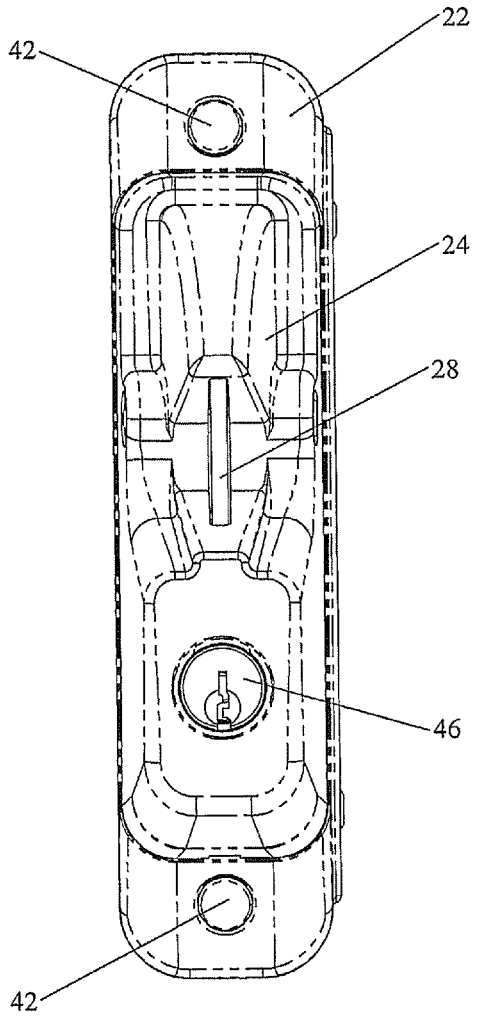
FIG. 6 is a front elevation of the front unit of FIG. 5.
Figure 7:
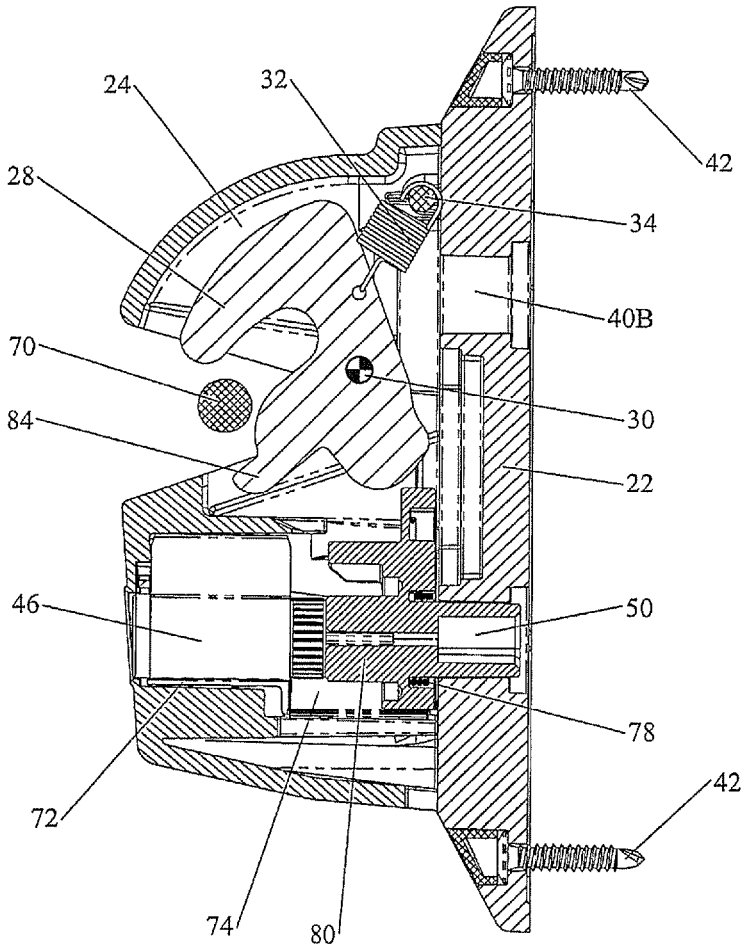
FIG. 7 is a view corresponding with FIG. 5 showing engagement by a striker bar about to engage and rotate the latching tongues to release the rotor to lock the tongue in a down position (as shown in FIG. 5)
Figure 8:
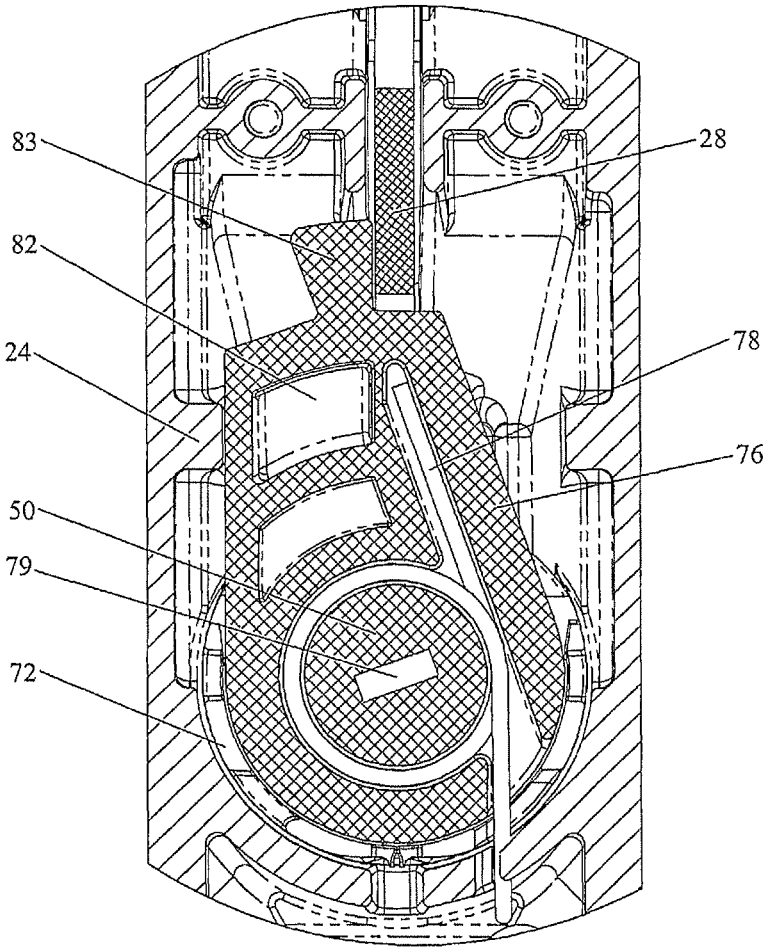
FIG. 8 is a part sectional rear of the body view on an enlarged scale taken in a plane at right angles to the axis of the cylinder lock and rotor showing inter-engagement between the tongue and the rotor prior to engagement of the striker bar, the rotor being held displaced from its final locking position.
Figure 9:
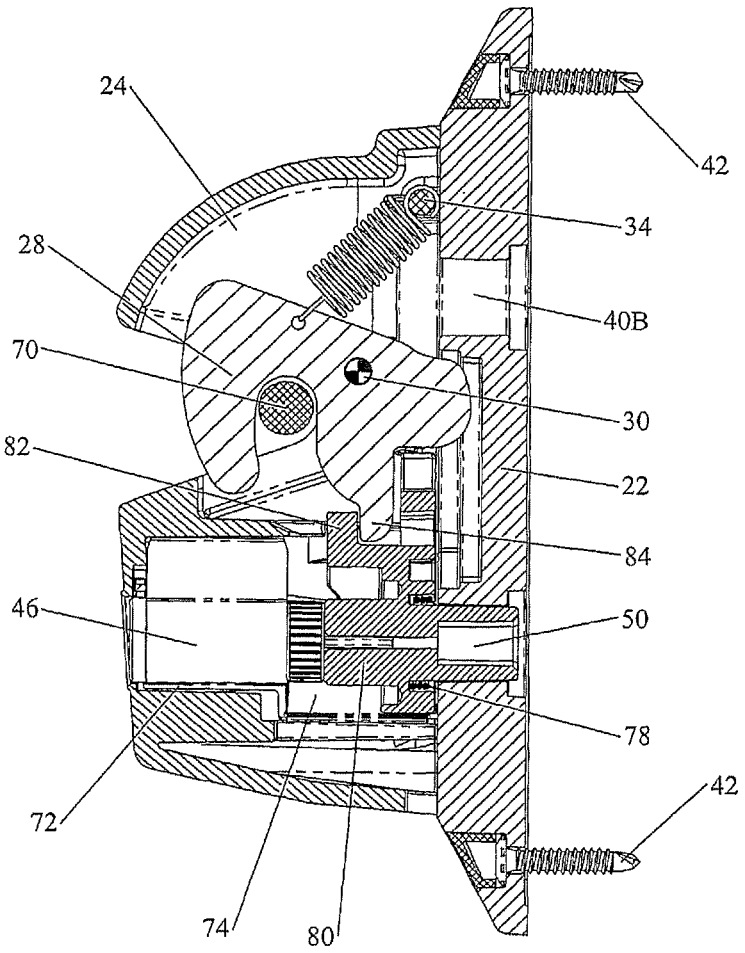
FIG. 9 corresponds with FIG. 7 but shows the components when in the locked position.
Figure 10:
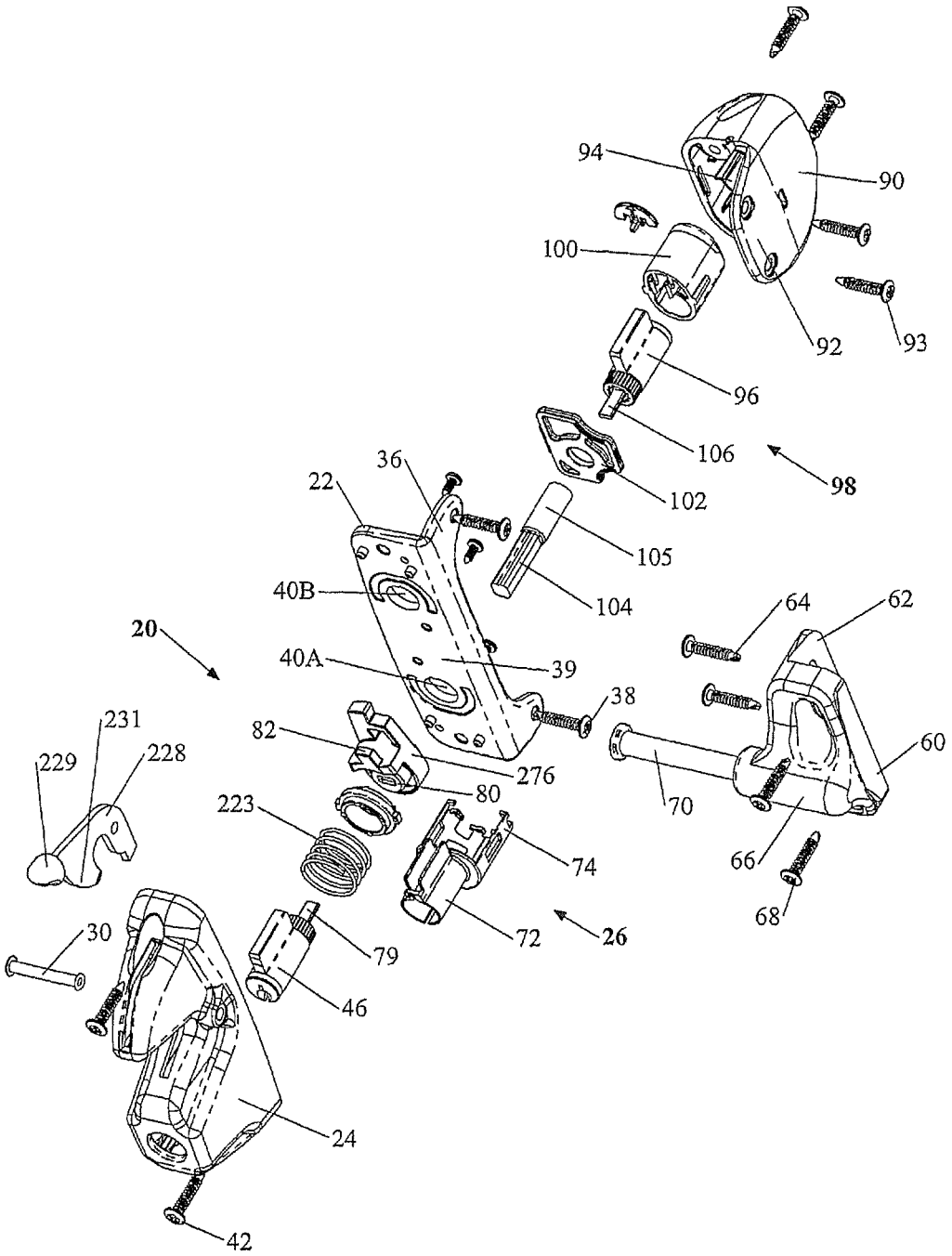
FIG. 10 is an exploded view of a front unit for a latch of a second embodiment.
Figure 11:
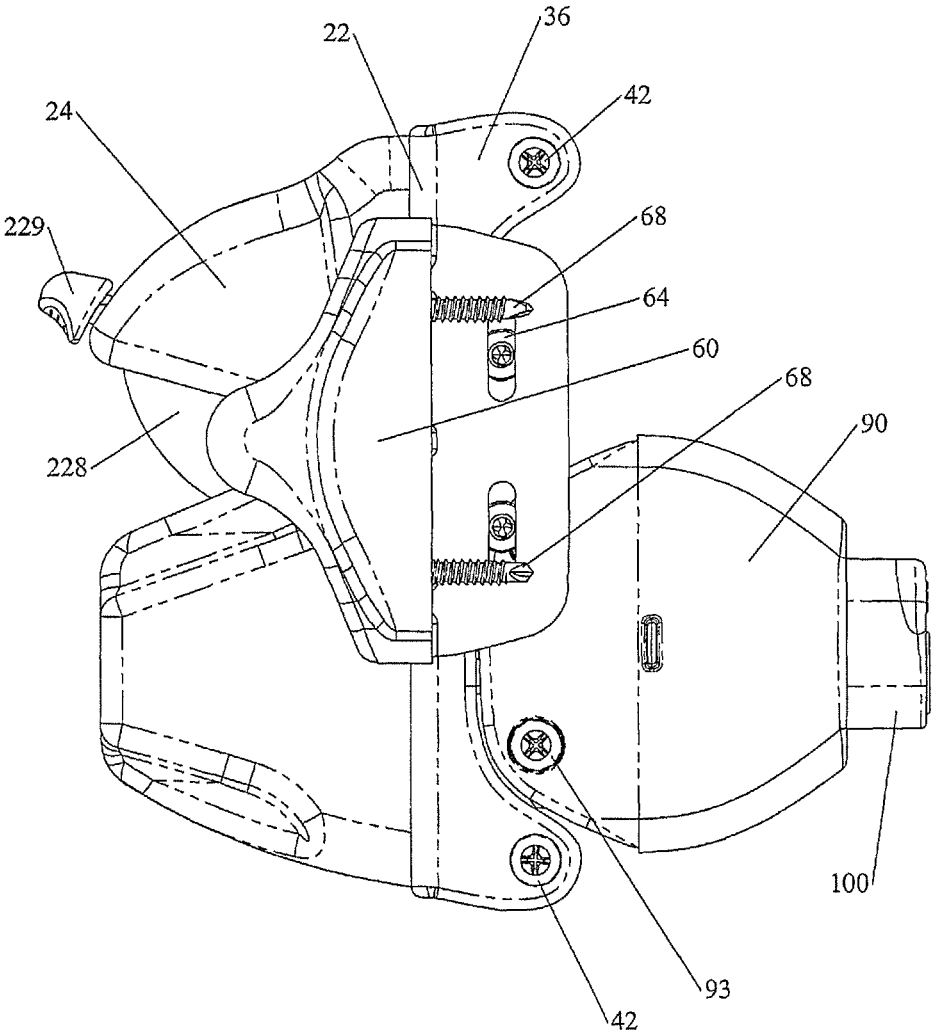
FIG. 11 is a side elevation of the second embodiment.
Figure 12:
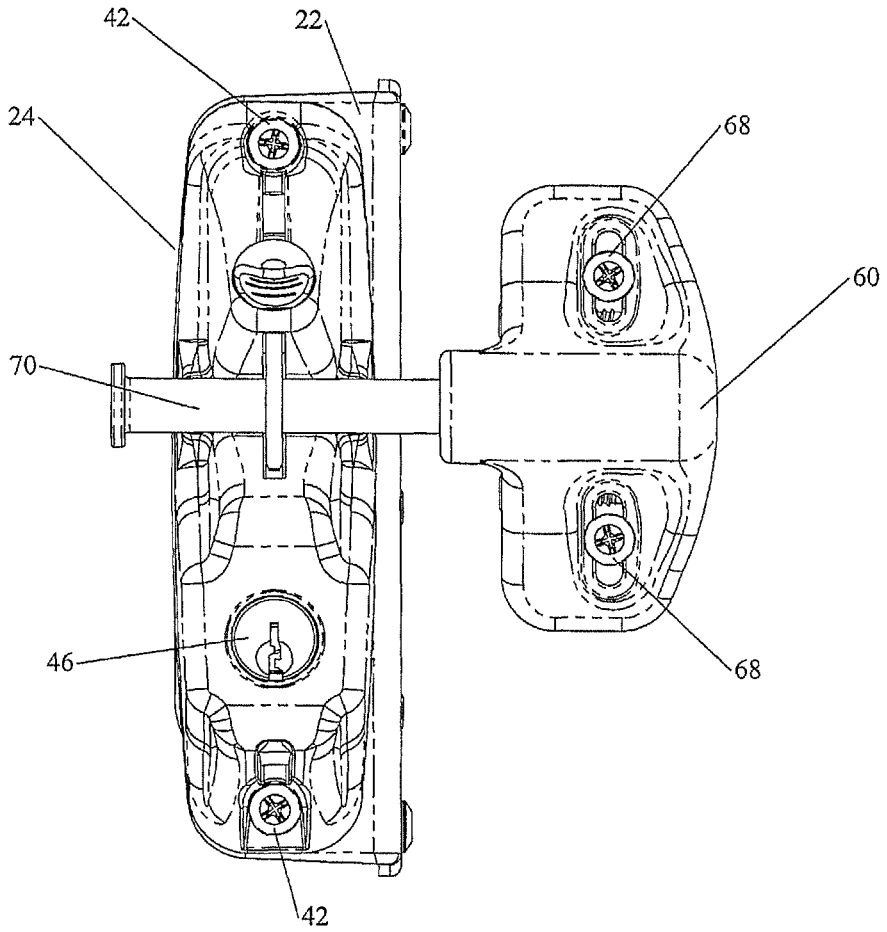
FIG. 12 is a front elevation of the second embodiment.
Figure 13:
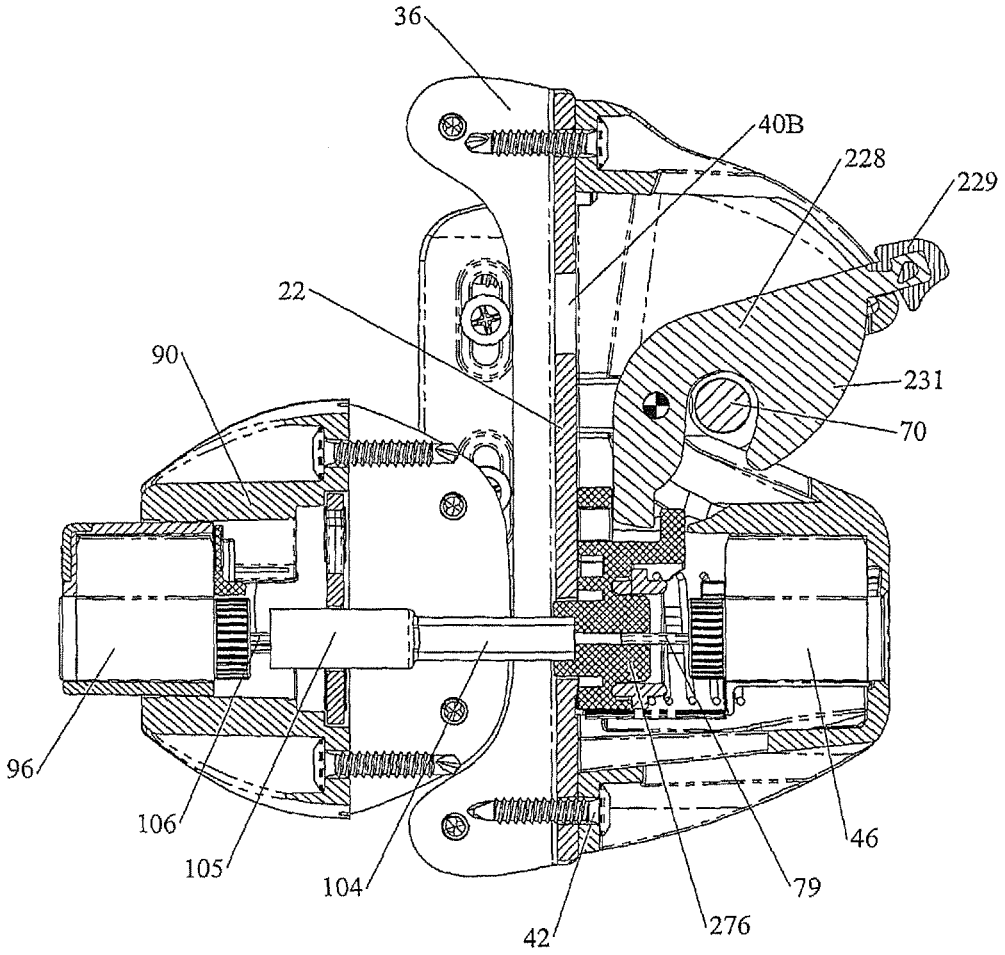
FIG. 13 is a central cross-sectional side elevation of the second embodiment with an optional rear locking unit in position.
Figure 14:
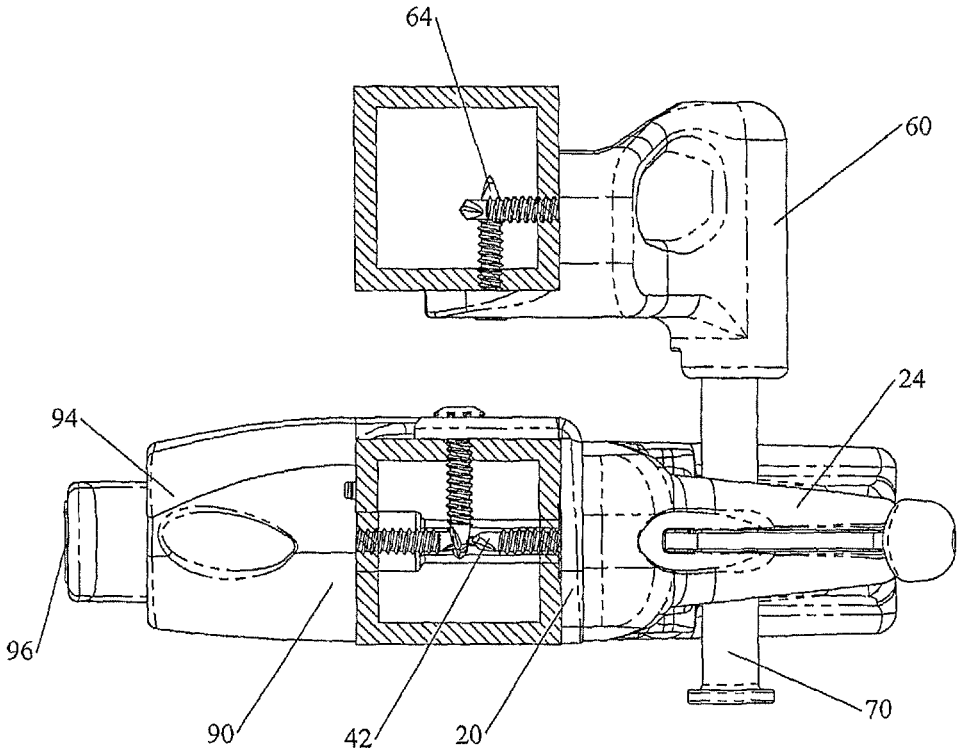
FIG. 14 is a plan view of the embodiment of FIG. 13 positional on a gate post with a striker arm unit positioned on a gate.

More detail of assembly is shown in FIG. 5 in which, for ease of reading the drawings, the extension spring 32 is shown not engaged with the tongue so it has fallen under gravity the position it will have adopted when pushed in an anticlockwise direction by a striker bar. FIG. 5 is a section in a central plane and shows the space around the leg 84 of the tongue, the side face of the tongue acting as an interference element for a side face of the finger 82 of the rotor (which is visible in FIG. 5).

Figure 4:
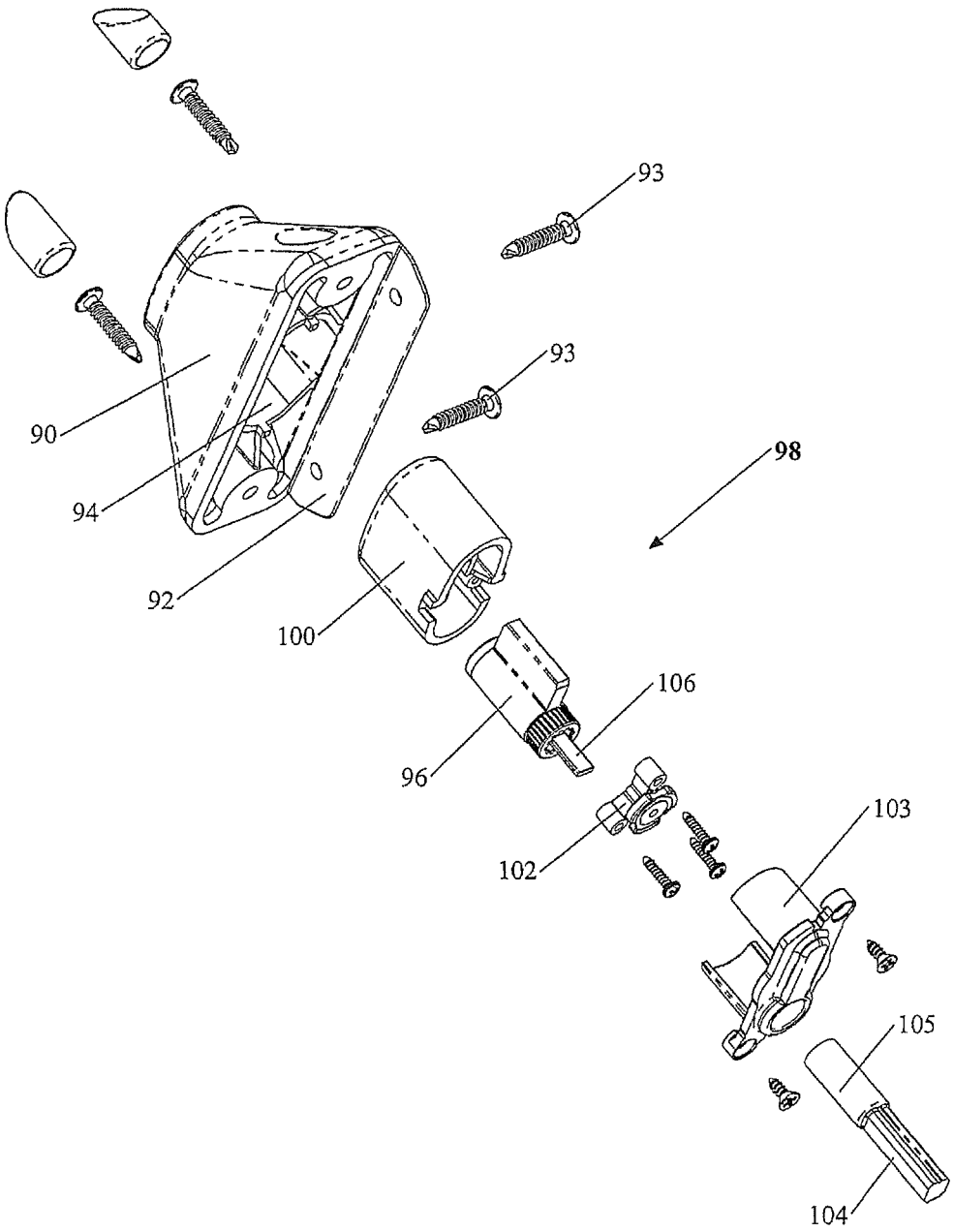
FIG. 4 is an exploded view of a rear access unit for use with the embodiment of FIG. 1.

Referring now to FIG. 4, the optional rear access unit has a housing 90 of general L-shape and having a side leg 92 adapted to be fixed by screws 93 to the side of a gate and a casing 94 adapted to mount a lock 96 and an actuator assembly 98. The lock is mounted in a button 100 which extends axially within a corresponding passage in the casing 94. The housing 90 also mounts a base element 102 to retain lock 96 in button 100. The actuating unit has a body portion 103 so that the lock and the button are biased to an outward position. The left hand end of the actuator comprises a barrel 105 having a rectangular slot into which the end of the operating bar 106 of the cylinder lock 96 engages for transmitting rotational force. The right hand end of the actuator 104 comprises a substantially square cross-section drive bar for engaging in the barrel 50 of the rotor 76. Thus, by virtue of the lock 96 being a left hand operating lock, a key is rotated anti-clockwise to take up initial lost motion and then further displaced to rotate the bar 104 clockwise when seen in the view of FIG. 4, whereby the rotor is rotated towards its opening position and can release the latching tongue to more upwardly under its spring bias.

In this embodiment the button 100 is either not axially displaceable or, if axially displaceable, it is so by virtue of the bar 104 not fully penetrating the cavity in the rotor. In either event, any movement of the button if possible does not cause any function whatsoever but the structure described above has useful design criteria so that the unit may be useable in a second embodiment or, at least, many components of FIG. 4 are useable so that the manufacturer can cost effectively assemble and provide different embodiments for different market needs. For the purpose of this first embodiment with the self-locking front unit, there is no purpose in the button 100 being axially displaceable.

In summary, the embodiment described above lends itself to efficient robust construction with relative simplicity in terms of the number of components and assembly. Furthermore, an important aspect is ease of fitting with hand tools and handheld drills to gates and gate posts. A single aperture is all that is needed to extend between the rear wall and front wall of a gate post in order to mount the optional rear access unit to engage in alignment with the front latch assembly. By contrast, if drillings are required at spaced parallel locations for two operating actuators, there is a great difficulty in achieving on site precision with hand tools.

Referring to the second embodiment with reference to FIGS. 10-14, like parts have been given like reference numerals, even though the specific configuration of certain parts may differ. In the case that a part is of a modified form compared with the first embodiment for different functionality, its reference numeral is 200 greater than the reference numeral used with reference to the first embodiment.

A significant difference in the second embodiment is that there is not automatic or self locking functionality but instead a lockable cylinder lock (46, 96) is provided in each of front and rear units and either may be actuated to unlock and leave unlocked the latch or manually to lock the latch. Either lock may be turned to unlock the latch and, in this embodiment, the tongue 228 has a projecting tab 229 having a finger engagement tip so the tongue may be lifted manually. In this instance the tongue is profiled so as to have a leading nose portion 231 which is adapted to be impacted by the striker pin when a gate is closed so as to rotate the tongue than upwardly to permit the striker pin to engage behind the latching shoulder and the tongue drops down under gravity in this embodiment to perform the latching function. Adaptations of such an embodiment include providing a lock in either or neither of the front or rear units but using interior components such as the rotor. Thus a suite of embodiments for different applications are based on the same interior rotor arrangements.

A key distinction of the rear operating unit in the illustrated embodiment is that the lock 96 is mounted in a depressible button 100 and the rotor 276 in the front unit has limited axial movement against the restoring force of a compression spring 223. The arrangement is such that opening the latch from the rear of the gate requires the button 100 to be pressed so that the actuating bar 104 moves forwardly and thereby pushes the rotor to a limited axial extent, providing it is in the unlocked position to engage a rear surface of the tongue to push it upwardly through a rotation about its pillet.

In the locked position the rotor, however, has its upwardly projecting finger engaging in front of the rear leg of the tongue thereby preventing it moving forward.

The invention claimed is:

1. A latch assembly for holding closed a gate or door wherein the latch assembly is adapted to co-operate with a striker arm, the latch assembly comprising:

a latch mountable to the gate or a gate post; and a remote actuating unit mountable on an opposite side of the gate or gate post to the latch; the latch comprising:

(a) a housing in which (b) a displaceable latching element is mounted to be displaceable from a latching position towards an open position in which the striker arm is released for gate or door opening, and (c) the latching element having a latching shoulder to retain the striker arm when engaged behind the latching shoulder and having an engagement surface adapted to be engaged by the striker arm when the gate or door is moved towards a closed position to displace the latching element and for permitting relative movement of the striker arm to adopt a position behind the latching shoulder, (d) a key-operated lock mounted in the housing and having a key operation for unlocking the latch, (e) a locking element for locking the latching element and adapted to be displaced upon actuation of the key-operated lock between a locking position, in which movement of the latching element is restrained from moving, and a displaced position in which the latching element is free to be moved, (f) the locking element being in the form of a rotor rotatably mounted in the housing, the rotor being movable about its axis for directly engaging with and disengaging from the latching element and (g) a connector connecting the rotor to the remote actuating unit for remotely operating the latch via the rotor, wherein one end of the connector is received by a portion of the rotor, and the other end of the connector is mounted to the remote actuating unit to enable the remote actuating unit to remotely operate the latch via the rotor.

2. A latch assembly as claimed in claim 1, wherein the remote actuating unit comprises a second key-operated lock that connects and transmits rotation to the rotor, whereby the housing key-operated lock or the second key-operated lock can be used to displace the locking element between the locking position and the displaced position.

3. A latch assembly as claimed in claim 2, wherein when the locking element is in the displaced position, to permit opening of the gate, at least one of the key-operated locks is able to be axially displaced to move the latching element from the latching position toward the open position to release the striker arm for moving out of engagement as the gate opens.

4. A latch assembly as claimed in claim 2, wherein the remote actuating unit further comprises an axially displaceable element which engages with and displaces the rotor against a spring biasing means to allow remote actuation of the latching element to open the latch.

5. A latch assembly as claimed in claim 1, wherein the latching element is pivotally mounted and fully enshrouded in the housing apart from a striker arm retaining portion which extends across an opening through which the striker arm moves upon gate or door closure.

6. A latch assembly as claimed in claim 1, wherein the key-operated lock is a rotary cylinder lock rotatable around a lock axis.

7. A latch assembly as claimed in claim 6, wherein the rotor has rotary motion of about 20° between the locking position and displaced position.

8. A latch assembly as claimed in claim 2, wherein the housing key-operated lock and the second key-operated lock are rotary cylinder locks and wherein when the latch is locked, turning of either key-operated lock rotates the rotor to move the locking element from the locking position to the displaced position to release the latching element.

9. A latch assembly as claimed in claim 3, wherein the at least one of the key-operated locks that is able to be axially displaced is the second key-operated lock.

10. A latch assembly as claimed in claim 4, wherein at least one of the key-operated locks is turned to permit opening of the gate and displaced to release the latching element from the latching position towards an open position when the rotor has been moved from a locking position into a position in which the latching element is free to be moved, and the rotor is displaced against the biasing toward the open position to release the striker arm for moving out of engagement as the gate opens.

11. A latch assembly as claimed in claim 1, wherein the latch assembly is configured as a gravity latch and the latching element is pivotal and is biased by gravity to the latching position.

12. A latch assembly as claimed in claim 2, whereby either the housing key-operated lock or the second key-operated lock can be used either for locking the latching element or displacing the latching element to the open position.

13. A latch assembly as claimed in claim 1, wherein the housing further comprises an L-shaped base plate for mounting onto the gate or door, whereby the L-shaped based plate allows the housing to be mounted for either left hand or right hand installation.

14. A latch assembly as claimed in claim 13, wherein the latching element is partially enshrouded in the housing with a protruding portion extending out of a face slot so as to facilitate manual lifting of the latching element when the latch has been unlocked.

15. A latch assembly as claimed in claim 14, wherein the rotor is rotatably mounted about the lock axis.

16. A latch assembly for holding closed a gate, or door wherein the latch assembly is adapted to co-operate with a striker arm, the latch assembly comprising:

a latch mountable to the gate or a gate post; and a remote actuating unit mountable on an opposite side of the gate or gate post to the latch; the latch comprising:

(a) a housing in which (b) a displaceable latching element is mounted to be displaceable from a latching position towards an open position in which the striker arm is released for gate opening, and (c) the latching element having a latching shoulder to retain the striker arm when engaged behind the latching shoulder and having an engagement surface adapted to be engaged by the striker arm when the gate is moved towards a closed position to displace the latching element and for permitting relative movement of the striker arm to adopt a position behind the latching shoulder (d) a key-operated lock mounted in the housing and having a key operation for unlocking the latch, (e) a locking element for locking the latching element and adapted to be displaced upon actuation of the key-operated lock between a locking position, in which movement of the latching element is restrained from moving, and a displaced position in which the latching element is free to be moved, (f) the locking element being in the form of a rotor rotatably mounted in the housing, said rotor being movable about its axis for directly engaging with and disengaging from the latching element and (g) a connector connecting the rotor to the remote actuating unit for remotely operating the latch via the rotor, wherein one end of the connector is received by a portion of the rotor, and the other end of the connector is mounted to the remote actuating unit to enable the remote actuating unit to remotely operate the latch via the rotor, and wherein the remote actuating unit further comprises a second key-operated lock in the remote actuating unit that connects and transmits rotation to the rotor, whereby the housing key-operated lock and the second key-operated lock are cylinder locks rotatable about an axis and can be actuated to displace the locking element between the locking position and the displaced position; and when the locking element is in the displaced position, at least one of the key-operated locks is able to be axially displaced to move the latching element from the latching position toward the open position to release the striker arm for gate opening.

17. A latch assembly for holding closed a gate or door wherein the latch assembly is adapted to co-operate with a striker arm, the latch assembly comprising:

a latch mountable to the gate or a gate post; and a remote actuating unit mountable on an opposite side of the gate or gate post to the latch; the latch comprising:

(a) a housing in which (b) a displaceable latching element is mounted to be displaceable from a latching position towards an open position in which the striker arm is released for gate opening, and (c) the latching element having a latching shoulder to retain the striker arm when engaged behind the latching shoulder and having an engagement surface adapted to be engaged by the striker arm when the gate is moved towards a closed position to displace the latching element and for permitting relative movement of the striker arm to adopt a position behind the latching shoulder, (d) a key-operated lock mounted in the housing and having a key operation for unlocking the latch, (e) a locking element for locking the latching element and adapted to be displaced upon actuation of the key-operated lock between a locking position, in which movement of the latching element is restrained from moving, and a displaced position in which the latching element is free to be moved, (f) the locking element being in the form of a rotor rotatably mounted in the housing, and said rotor is movable about its axis for directly engaging with and disengaging from the latching element and (g) a connector connecting the rotor to the remote actuating unit for remotely operating the latch via the rotor, wherein one end of the connector is received by a portion of the rotor, and the other end of the connector is mounted to the remote actuating unit to enable the remote actuating unit to remotely operate the latch via the rotor and the remote actuating unit further comprises a second key-operated lock in the remote actuating unit that connects and transmits rotation to the rotor, whereby the housing key-operated lock and the second key-operated lock are cylinder locks rotatable about an axis and can be actuated to displace the locking element between the locking position and the displaced position; and when the locking element is in the displaced position, at least one of the key-operated locks is able to be displaced to move the latching element from the latching position toward the open position to release the striker arm for gate opening.

* * * * *